US009919540B1

(12) United States Patent
Wong Mun Hon et al.

(10) Patent No.: US 9,919,540 B1
(45) Date of Patent: Mar. 20, 2018

(54) MOVABLE MEDIA GUIDE FOR MEDIA PROCESSING DEVICES

(71) Applicant: ZIH Corp., Lincolnshire, IL (US)

(72) Inventors: Randal Wong Mun Hon, Singapore (SG); Petrica Dorinel Balcan, Thousand Oaks, CA (US); Kuan-Ying Lu, Taichung (TW); Lawrence E. Smolenski, Newbury Park, CA (US); David L. Garbe, Ventura, CA (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 15/379,755

(22) Filed: Dec. 15, 2016

(51) Int. Cl.
*B41J 11/00* (2006.01)
*B41J 15/04* (2006.01)
*B41J 15/16* (2006.01)

(52) U.S. Cl.
CPC ..... *B41J 11/0045* (2013.01); *B41J 15/046* (2013.01); *B41J 15/16* (2013.01); *B41J 15/165* (2013.01)

(58) Field of Classification Search
CPC ..... B41J 11/00; B41J 11/0005; B41J 11/0045; B41J 11/0055; B41J 11/02; B41J 15/046; B41J 15/16; B41J 15/165; B41J 17/24; B65H 20/16; B65H 23/16
See application file for complete search history.

(56) References Cited

U.S. PATENT DOCUMENTS 5,823,374 A * 10/1998 Wu ..... B65D 9/14 217/51
6,028,318 A * 2/2000 Cornelius ..... B65H 7/00 177/1
6,682,190 B2 * 1/2004 Rasmussen ..... B41J 11/005 347/101
7,079,168 B2 7/2006 Ullenius et al.
9,028,034 B2 * 5/2015 Horaguchi ..... B41J 11/007 347/104
9,238,379 B2 * 1/2016 Takizawa ..... B41J 13/0009
9,731,518 B2 * 8/2017 Luedeman ..... B41J 11/0045

* cited by examiner

*Primary Examiner* — Anh T.N. Vo

(57) ABSTRACT

A media processing device includes a cavity configured to receive a supply of media; a media exit; a fixed media guide configured to guide the media along a media feed path from the cavity to the media exit; a platen roller configured to move the media along the media feed path from the supply toward the media exit; and a movable media guide extending laterally across the media feed path at a position between the platen roller and the cavity. The movable media guide is biased toward the media feed path and is configured to apply a force to the media. The movable media guide is convexly curved toward the media feed path.

16 Claims, 14 Drawing Sheets

MOVABLE MEDIA GUIDE FOR MEDIA PROCESSING DEVICES

BACKGROUND

Media processing devices such as printers typically include a supply of media such as paper or labels, and a mechanism to draw the media from the supply past a printhead. The printhead generates human and/or machine-readable indicia on a surface of the media before dispensing the media. The quality of the indicia may be negatively affected by irregularities in the movement of the media from the supply to the printhead.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate implementations of concepts described herein, and explain various principles and advantages of those implementations.

Figure 1:
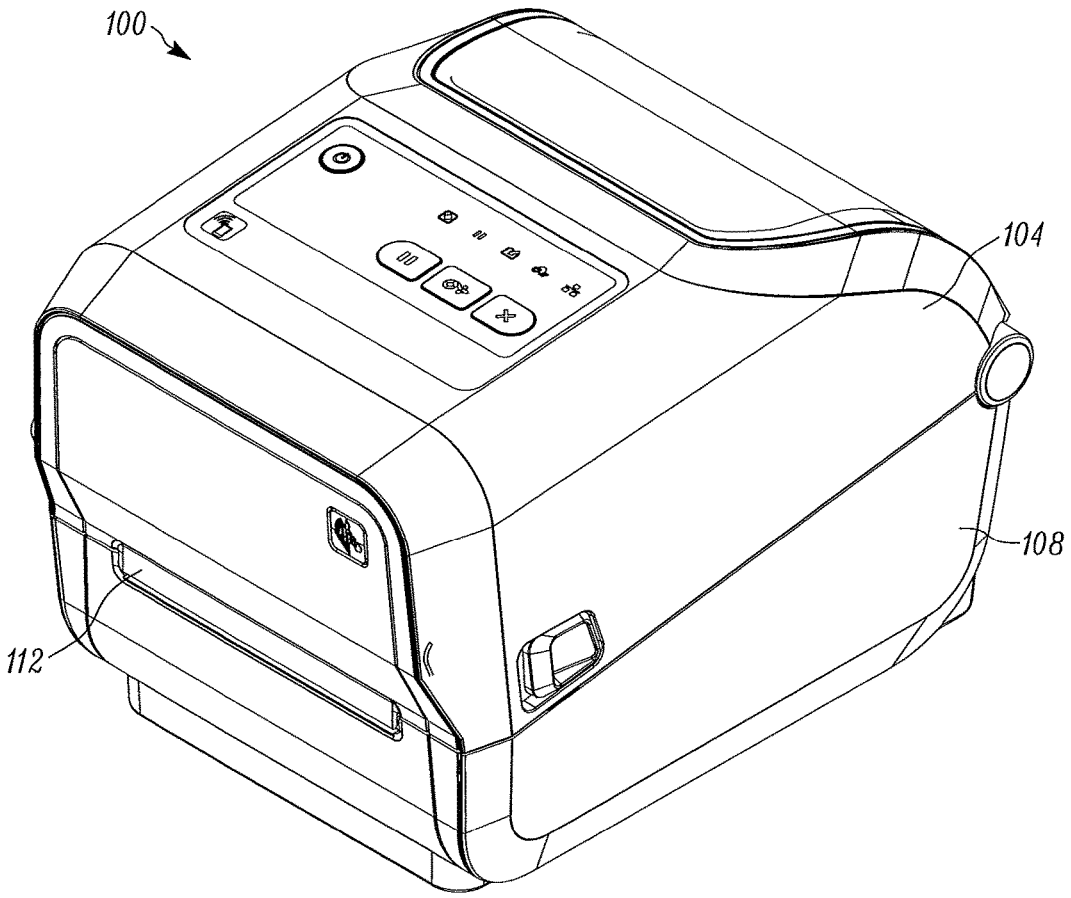
FIG. 1 depicts an example media processing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations of the present specification.

The apparatus components have been represented where appropriate by conventional symbols in the drawings, showing only those specific details that are pertinent to understanding the implementations of the present specification so as not to obscure the disclosure with details that will be readily apparent to those of ordinary skill in the art having the benefit of the description herein.

DETAILED DESCRIPTION

Media processing devices, such as printers of labels, tags, wrist bands, transaction receipts and the like typically contain a supply of print media, such as a roll of paper, a roll of labels arranged on a liner, or a roll of adhesive-backed linerless material. As used herein, "print media" refers to media on which human and/or machine-readable indicia can be generated. The supply of print media is sometimes referred to herein as a "web." For example, when the printer is loaded with adhesive labels arranged on a liner, the term "web" refers to a combination of the liner and the print media, which includes one or more layers of, for example, heat-reactive dye, protective coating, label substrate, liner substrate, release coating, and/or adhesive. When the printer is loaded with a roll of linerless print media, the "web" refers to the print media, which includes one or more layers of, for example, label substrate, heat-reactive dye, protective coating, release coating, and/or adhesive.

Such devices often include a mechanism such as a platen roller to draw the web from a storage area containing the supply toward a printhead for application of pigment, heat or any other suitable treatment that generates indicia on the print media. When such printers are at rest, the roll of print media sometimes shifts, allowing slack to develop in the web extending toward the platen roller. When operation of the printer resumes, the slack is taken up by the platen roller before the roll begins to rotate to dispense additional print media. The sudden transition from take-up of slack to rotation of the roll may cause the print media to jerk in its travel (i.e. to suffer a sudden change in travel speed). This jerk may be more pronounced at greater print speeds (e.g. at speeds for which the print media moves past the printhead at a rate greater than six inches per second, or IPS). In some instances, the jerk negatively impacts print quality. For example, the print media under treatment at the printhead at the time of the jerk may bear undesirable artifacts, such as an undesirable dark line. While this negative impact is undesirable in any application, unwanted marks are especially problematic when generating barcodes. In particular, media processing devices that print barcodes suffer from an artifact such as the above-mentioned dark line due to the negative impact on the readability of a printed barcode. Another undesirable artifact may include variation in the relative width of a wide bar to a narrow bar, or in spaces between bars, either of which could make it more difficult for a machine to read the barcode.

Examples disclosed herein are directed to a media processing device including: a cavity configured to receive a supply of media; a media exit; a fixed media guide configured to guide the media along a media feed path from the cavity to the media exit; a platen roller configured to move the media along the media feed path from the supply toward the media exit; and, a movable media guide extending laterally across the media feed path at a position between the platen roller and the cavity. The movable media guide is biased toward the media feed path and configured to apply a force to the media. The movable media guide is convexly curved toward the media feed path.

FIG. 1 depicts an example media processing device 100 constructed in accordance with teachings of this disclosure. The media processing device 100 includes a housing defined by a cover 104 and a base 108. As will be described herein, the media processing device 100 stores a supply of print media and generates indicia on the print media before dispensing the print media from a media exit 112 in the housing. In the illustrated example, the media processing device 100 employs thermal transfer printing technology to transfer ink from a ribbon to the print media. Additional or alternative print technologies, such as direct thermal printing technology, may be utilized to generate the indicia. In some examples, processing of the print media also includes encoding data in an integrated circuit, such as a radio frequency identification (RFID) tag, embedded in the media.

Figure 2:
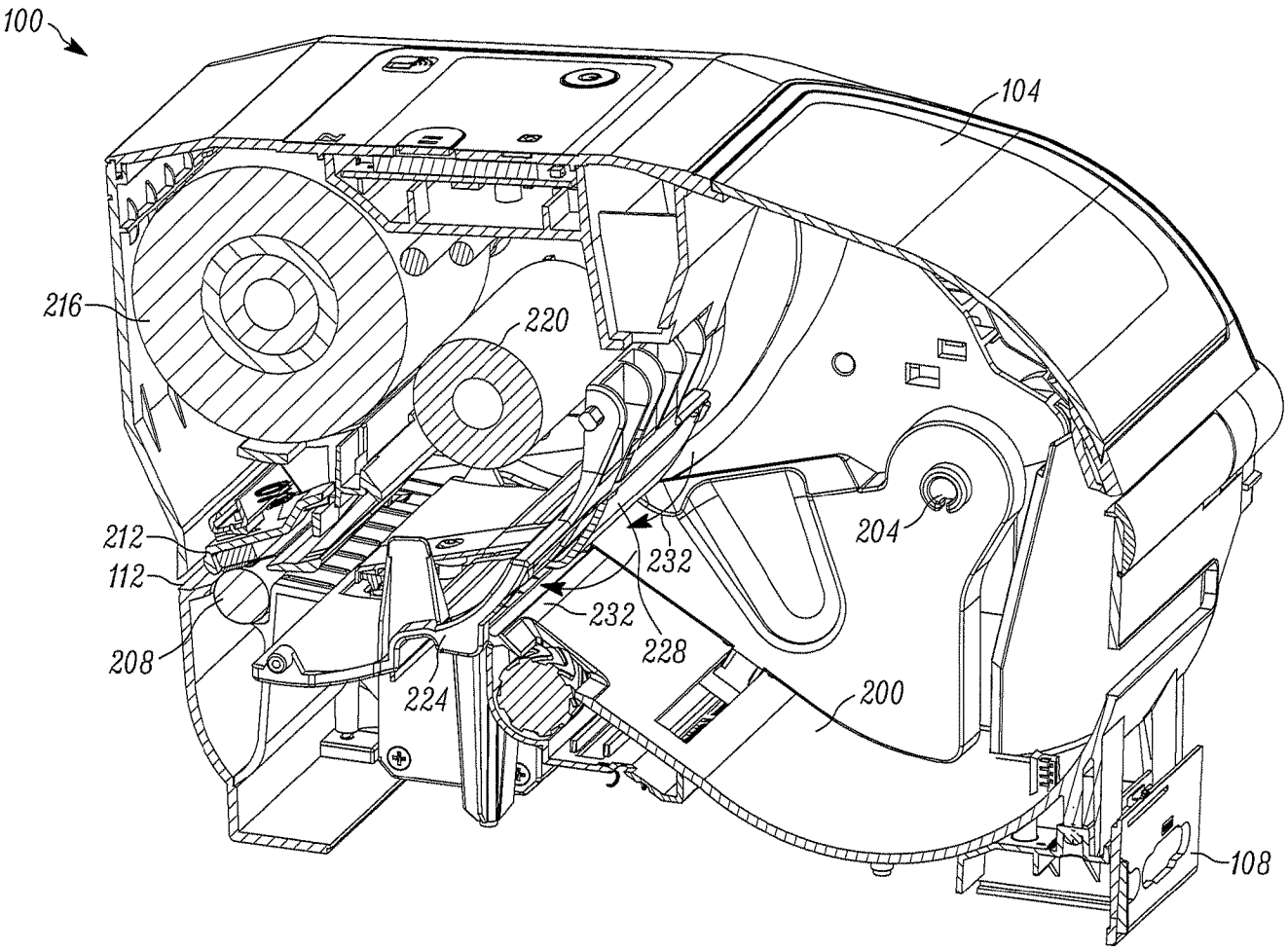
FIG. 2 depicts a partial section view of the media processing device of FIG. 1.

Turning to FIG. 2, a partial cutaway view of the example media processing device 100 of FIG. 1 is depicted, in which a portion of the base 108 has been omitted. As seen in FIG. 2, the media processing device 100 includes a cavity 200 configured to receive a supply of print media. The supply of print media, in the example media processing device 100, is a spool (omitted in FIG. 2) configured to be received within the cavity 200. The print media is a web of paper, synthetic material, wrist bands, labels or the like rolled around the spool in a stored state, and the spool is rotatable within the cavity 200 to dispense (i.e. unroll) the print media. In the example media processing device 100 shown in FIG. 2, the spool is configured to mount on a spindle 204 (and an opposing spindle not shown in FIG. 2) and to rotate about an axis defined by the spindle 204 to dispense the print media.

The spool is rotated about the above-mentioned axis under the action of a platen roller 208, which in conjunction with a printhead 212 forms a nip through which the print media passes toward the media exit 112. The platen roller 208 pulls the web from the spool through the nip and toward the media exit 112. In this example, the media processing device 100 is a thermal transfer printer. Accordingly, during printing operations, an ink ribbon (not shown) travels from a supply roller 220, through the nip, and then to a take-up roller 216. Accordingly, the ink ribbon travels along an ink ribbon path that is different than, a path traveled by the print media. The ink ribbon passes through the nip at the same time as the web. As the ink ribbon and the web pass through the nip, the ink ribbon is in contact with the print media of the web. To generate the indicia, certain elements (e.g., printhead dots) of the printhead 212 are selectively energized (e.g., heated) according to machine-readable instructions (e.g., print line data or a bitmap). When energized, the elements of the printhead 212 apply energy (e.g., heat) to the ink ribbon to transfer ink to specific portions of the print media. In other examples, when the media processing device is configured for direct thermal printing, direct thermal media (but not an ink ribbon) is fed across the printhead and the elements of the printhead apply energy directly to the print media, which changes color (e.g., from white to black or color) in response to the energy.

The example media processing device 100 of FIG. 1 includes a fixed media guide configured to guide the web dispensed from the spool along a media feed path—which will be described below in greater detail—from the cavity 200 toward the media exit 112. The platen roller 208 is configured to move the web along the media feed path from the cavity 200 toward the media exit 112. The fixed media guide includes an arm 224. As will be apparent from the discussion below, the fixed media guide also includes any suitable number of surfaces, which need not be contiguous, in addition to the arm 224, and is referred to as "fixed" because it is immobile relative to the cover 104 at least during operation of the media processing device 100 (i.e. during treatment and dispensing of media). Put another way, the fixed media guide is part of a stationary frame of the media processing device 100. As will be described below, in the example media processing device 100 of FIG. 2, certain portions of the fixed media guide (notably the arm 224) are permitted to move relative to the cover 104 during maintenance of the media processing device 100.

The example media processing device 100 of FIG. 1 includes a movable media guide 228 at a position along the media feed path between the cavity 200 and the platen roller 208. The movable media guide 228 extends laterally across the media feed path; that is, a longest dimension of the movable media guide 228 lies perpendicular to the direction of travel of the web, which is indicated by the arrows 232. As will be discussed below, the movable media guide 228 is biased toward the media feed path, and is configured to apply a dampening force to the web as the web travels along the media feed path.

Figure 3:
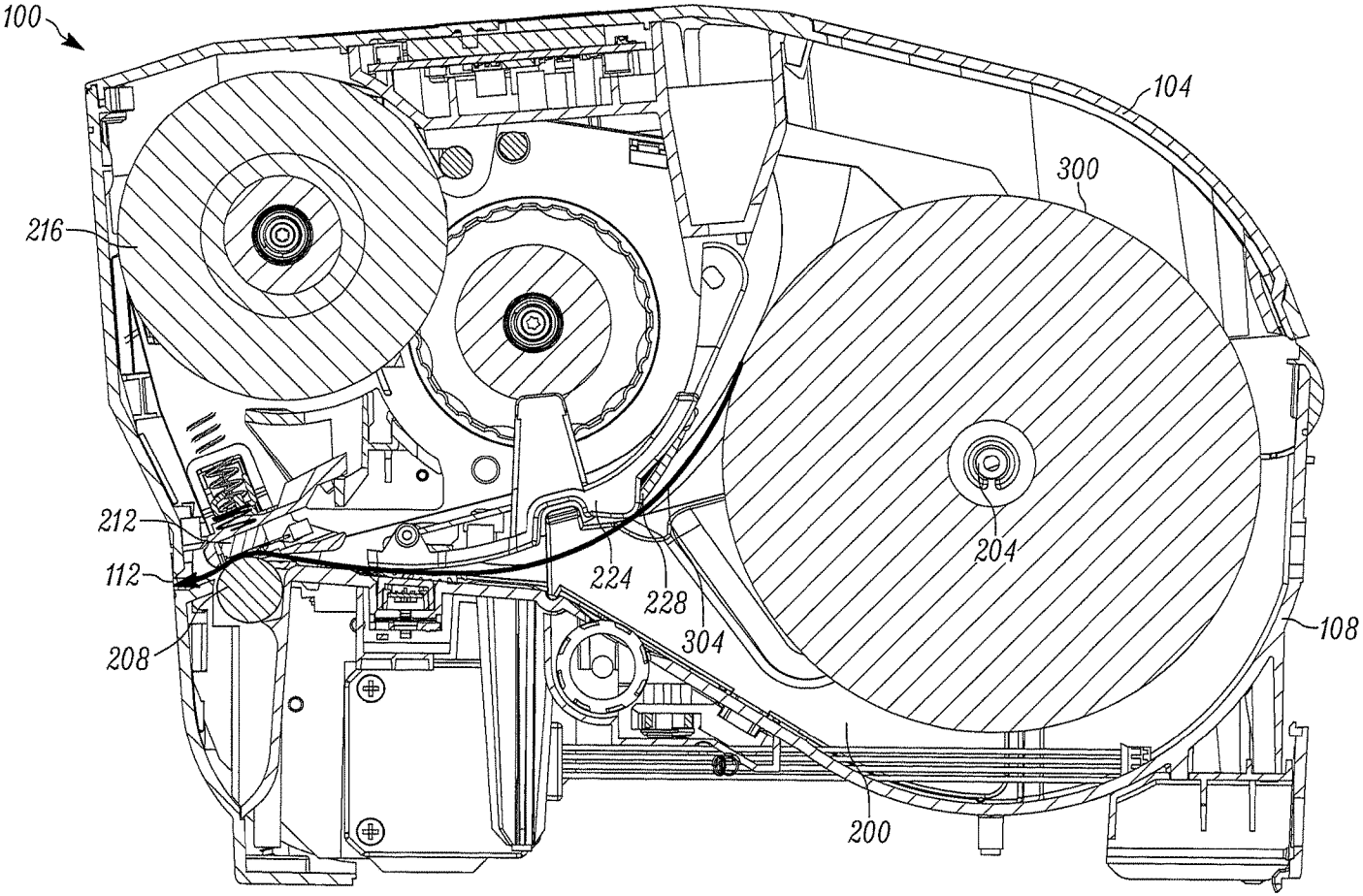
FIG. 3 depicts a cross sectional elevation view of the media processing device of FIG. 1, illustrating the media processing device in a resting state.

Referring now to FIG. 3, a cross section of the example media processing device 100 of FIG. 1 is shown, omitting a portion of the base 108. In addition to the components introduced above, FIG. 3 illustrates a spool 300 storing a rolled media web in the cavity 200. Also shown in FIG. 3 is a media feed path 304 as mentioned above in connection with FIG. 2. The media feed path 304 begins at the spool 300, and travels along the movable media guide 228 and the fixed media guide (including at least the arm 224) before reaching the nip formed by the platen roller 208 and the printhead 212, and finally the media exit 112.

The media feed path 304 illustrated in FIG. 3 is the path along which the media web from the spool 300 lies when the media processing device 100 is at rest (that is, when the platen roller 208 is not pulling the web toward the nip). In particular, the media feed path 304 shown in FIG. 3 indicates a degree of slack adjacent to the movable media guide 228. The slack arises, for example, due to residual motion of the spool 300 when the platen roller 208 ceases rotating. As the movable media guide 228 is biased toward the media feed path 304, the movable media guide 228 is shown in FIG. 3 in an extended position, in which the movable media guide 228 contacts the media web lying along the media feed path 304. In some examples, the movable media guide 228, as a result of its bias towards the media feed path 304, exerts a force on the media web sufficient to straighten the web downstream (i.e. toward the platen roller 208) of the movable media guide 228. In other examples, however, the movable media guide 228 need not exert such a force on the media web when the media web is at rest and lying along the media feed path 304.

Figure 4:
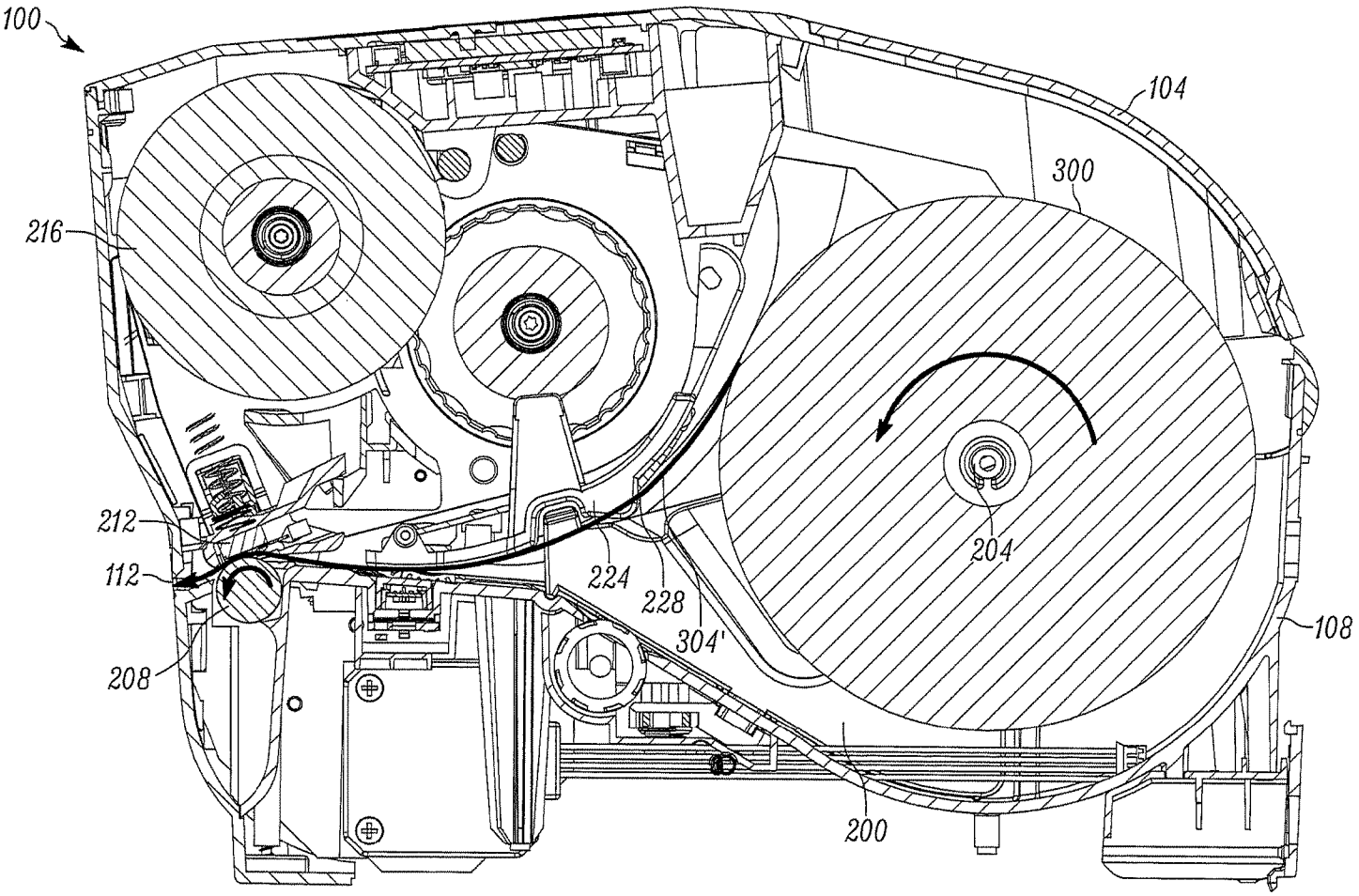
FIG. 4 depicts a further cross sectional elevation view of the media processing device of FIG. 1, illustrating the media processing device in an operational state.

Turning to FIG. 4, a further cross section of the example media processing device 100 of FIG. 1 is shown. In FIG. 4, however, the media processing device 100 is shown in operation. That is, the platen roller 208 is shown in rotation, and therefore acts to draw the web from the spool 300 along the media feed path 304 toward the media exit 112. When the platen roller 208 begins to rotate, the platen roller 208 is configured both to take up the slack in the web as illustrated in the resting state shown in FIG. 3, and to accelerate the spool 300 from rest to dispense additional print media. In taking up any slack in the web and in accelerating the spool 300 to an operating speed, the platen roller 208 rapidly increases the tension on the web. The rapid increase in tension causes the web to deviate from the media feed path 304 to a modified media feed path 304', illustrated in FIG. 4.

The movable media guide 228 is configured, as a result of its bias toward the media feed path 304 (i.e. the resting media feed path shown in FIG. 3), to apply a force to the web to dampen the movement of the web from the media feed path 304 to the modified media feed path 304'. In dampening the movement of the web away from the media feed path 304 and toward the modified media feed path 304', the movable media guide 228 is configured to move from the extended position shown in FIG. 3 to a compressed position shown in FIG. 4. The movable media guide 228 is configured to dampen the movement of the web such that when the deviation of the web from the media feed path 304 to the media feed path 304' is complete, the take-up of slack in the media web and the acceleration of the spool 300 are substantially complete. Put another way, the movable media guide 228 enjoys a degree of freedom of movement between the extended position and the compressed position, which will smoothen the rapid increase in tension on the web.

During operation of the media processing device 100, the web continues to travel from the spool 300 along the modified media feed path 304'. When the platen roller 208 ceases rotating, the web also ceases travelling through the nip. The spool 300 decelerates and comes to a stop. However, during the deceleration of the spool 300, additional print media is dispensed from the spool 300 that is not drawn along the media feed path 304' (as the platen roller 208 is no longer in motion). Therefore, the media web incurs some slack and returns to lie at rest along the media feed path 304 shown in FIG. 3. The letting out of slack in the media web, along with the bias of the movable media guide 228, causes the movable media guide 228 to resume the extended position shown in FIG. 3.

Figure 5:
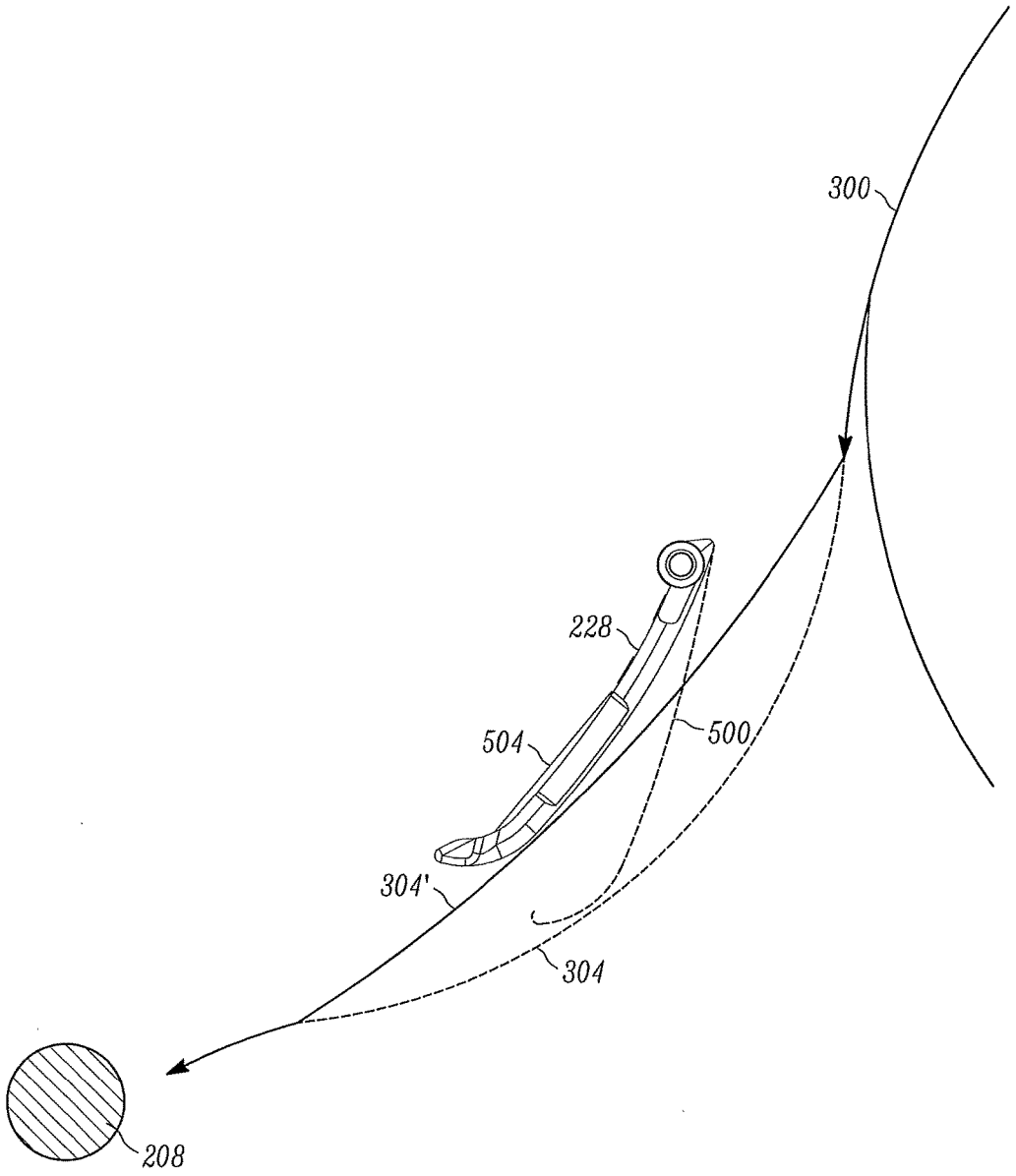
FIG. 5 depicts a schematic view of a media feed path and associated components of the media processing device of FIG. 1, in transition between the states shown in FIGS. 3 and 4.

Turning to FIG. 5, the transitions of the web and the movable media guide 228 between the operating and resting states are illustrated in greater detail. As noted above, at rest as well as at the beginning and end of periods of operation, the media web extending from the spool 300 to the platen roller 208 lies along the media feed path 304, and the movable media guide 228 is in an extended position 500 (illustrated in dashed lines) as a result of the bias of the movable media guide 228 toward the media feed path 304. As the platen roller 208 begins to rotate, the web deviates away from the media feed path 304 and toward the modified media feed path 304'. During such movement of the web, the slack in the web is taken up and the spool 300 begins to accelerate toward an operating speed while dispensing additional print media. The movable media guide 228 also moves from the extended position 500 to a compressed position 504 (illustrated in solid lines). The bias of the movable media guide 228 toward the media feed path 304, although not sufficient to completely prevent the web from moving away from the media feed path 304, dampens that movement. Therefore, the transition of the web from the media feed path 304 to the modified media feed path 304', and the associated acceleration of the spool 300, occur over a greater period of time than they would in the absence of the movable media guide 228. As such, the rapid increase in tension associated with the take up of the slack is dampened by movement of the movable media guide 228. Accordingly, the movable media guide 228 eliminates or reduces negative impacts (e.g., undesirable dark lines) on the indicia generated on the print media associated with the take up of the slack.

Figure 6:
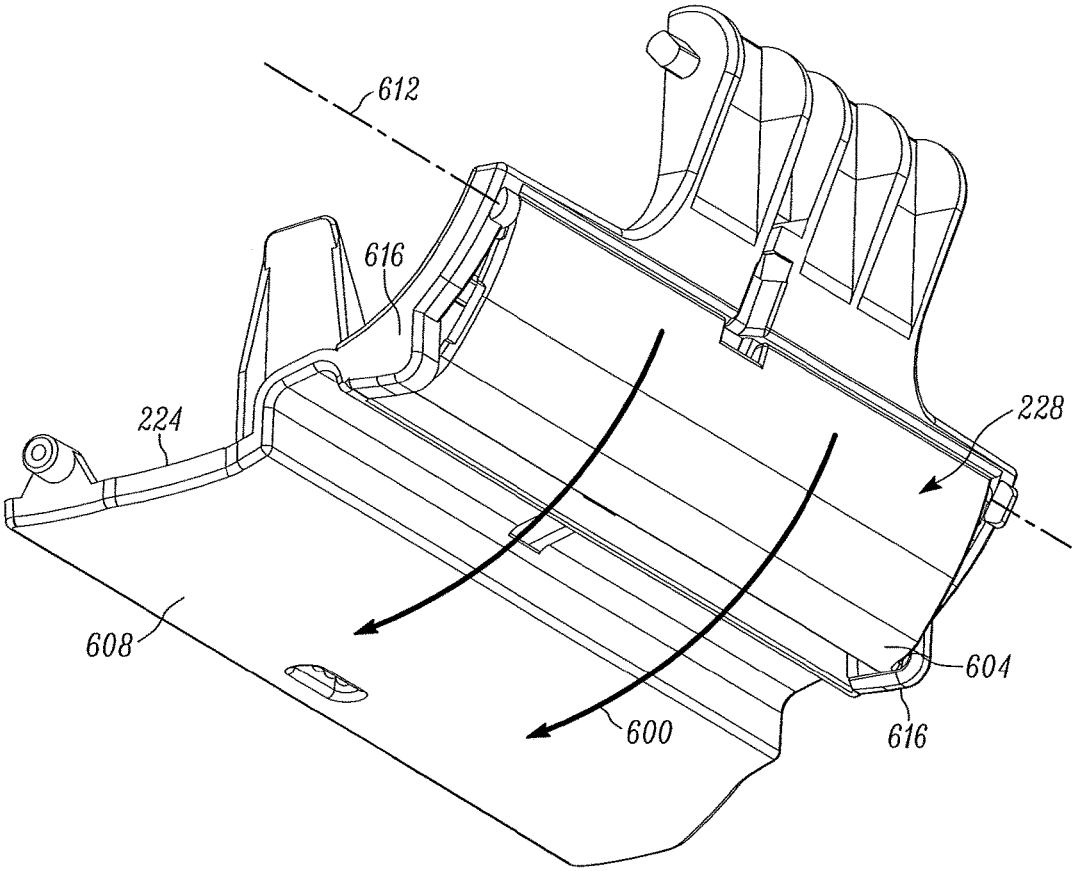
FIG. 6 depicts an arm and a movable media guide of the media processing device of FIG. 1, in an extended position.

Various structural configurations of the movable media guide 228 are contemplated. Turning to FIG. 6, the arm 224 and the movable media guide 228, as they appear in the example media processing device 100 of FIG. 1, are illustrated in isolation. The direction of travel of the web during operation of the media processing device 100 is also illustrated by arrows 600.

In the example of FIG. 6, the movable media guide 228 includes a surface 604 configured to extend laterally across the media feed path 304. The surface 604 is curved convexly toward the media feed path 304 (as also seen in FIG. 5), to guide the web onto a guide surface 608 of the arm 224. The movable media guide 228 is coupled to the arm 224 such that the movable media guide 228 can move relative to the arm 224. In the example of FIG. 6, the movable media guide 228 rotates relative to the arm 224 about an axis 612 between the extended and compressed positions. The axis 612 of FIG. 6 is defined by first and second points at which the movable media guide 228 is coupled to the arm 224. The example axis 612 of FIG. 6 extends perpendicular to the direction of travel of the web. In FIG. 6, the movable media guide 228 is shown in the extended position (i.e., extended away from the arm 224 relative to the compressed position).

The example arm 224 of FIG. 6 includes a pair of shoulders 616 configured to extend along either side of the web (when present), to assist in guiding the web along the media feed path 304 (as well as the modified media path 304'). The shoulders 616 limit the excursion of the movable media guide 228 toward the extended position.

Figure 7:
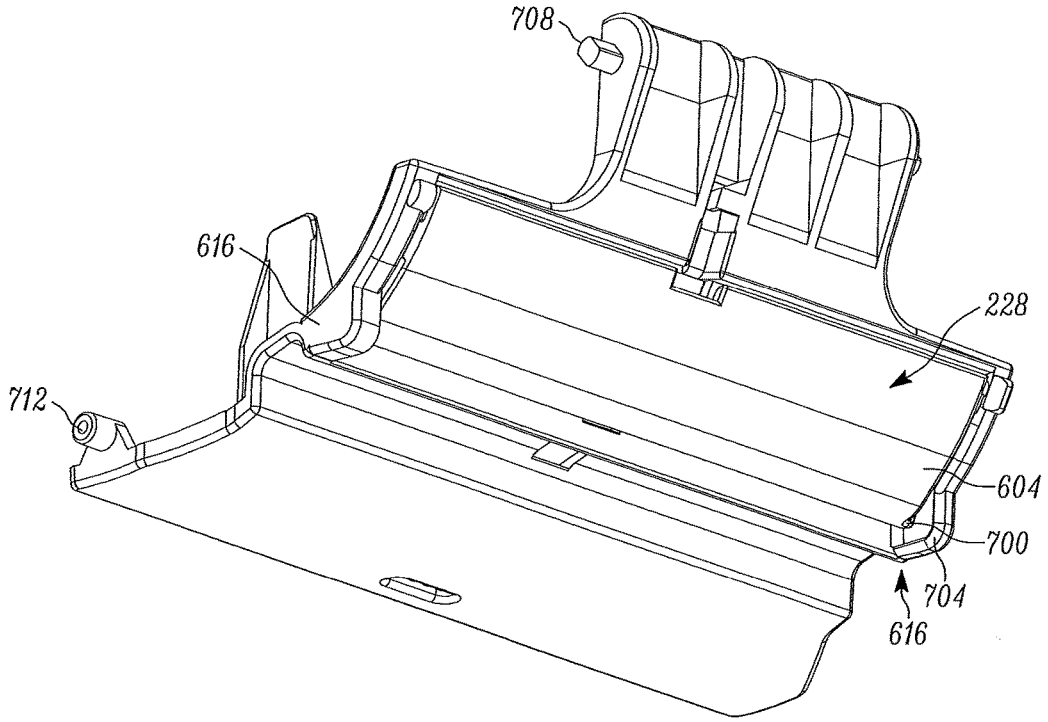
FIG. 7 depicts the arm and the movable media guide of the media processing device of FIG. 1, in a compressed position.

As seen in FIG. 7, which illustrates the arm 224 with the movable media guide 228 in the compressed position, each shoulder 616 defines a cavity 700 delimited by a wall 704 extending laterally (i.e. perpendicularly to the direction of travel of the media web). The movable media guide 228 is configured to engage the walls 704 in the extended position, thus inhibiting further movement of the movable media guide 228 toward the media feed path 304. That is, the walls 704 define a maximum distance or space between the atm 224 and the movable media guide 228.

As also illustrated in FIG. 7, the arm 224 includes a pair of axle pins 708 extending laterally from an upstream (relative to the movable media guide 228) portion of the arm 224, for connecting the arm 224 to the cover 104. The arm also includes a pair of laterally extending guide pins 712, for guiding movement of the arm 224 relative to the cover 104.

Figure 8:
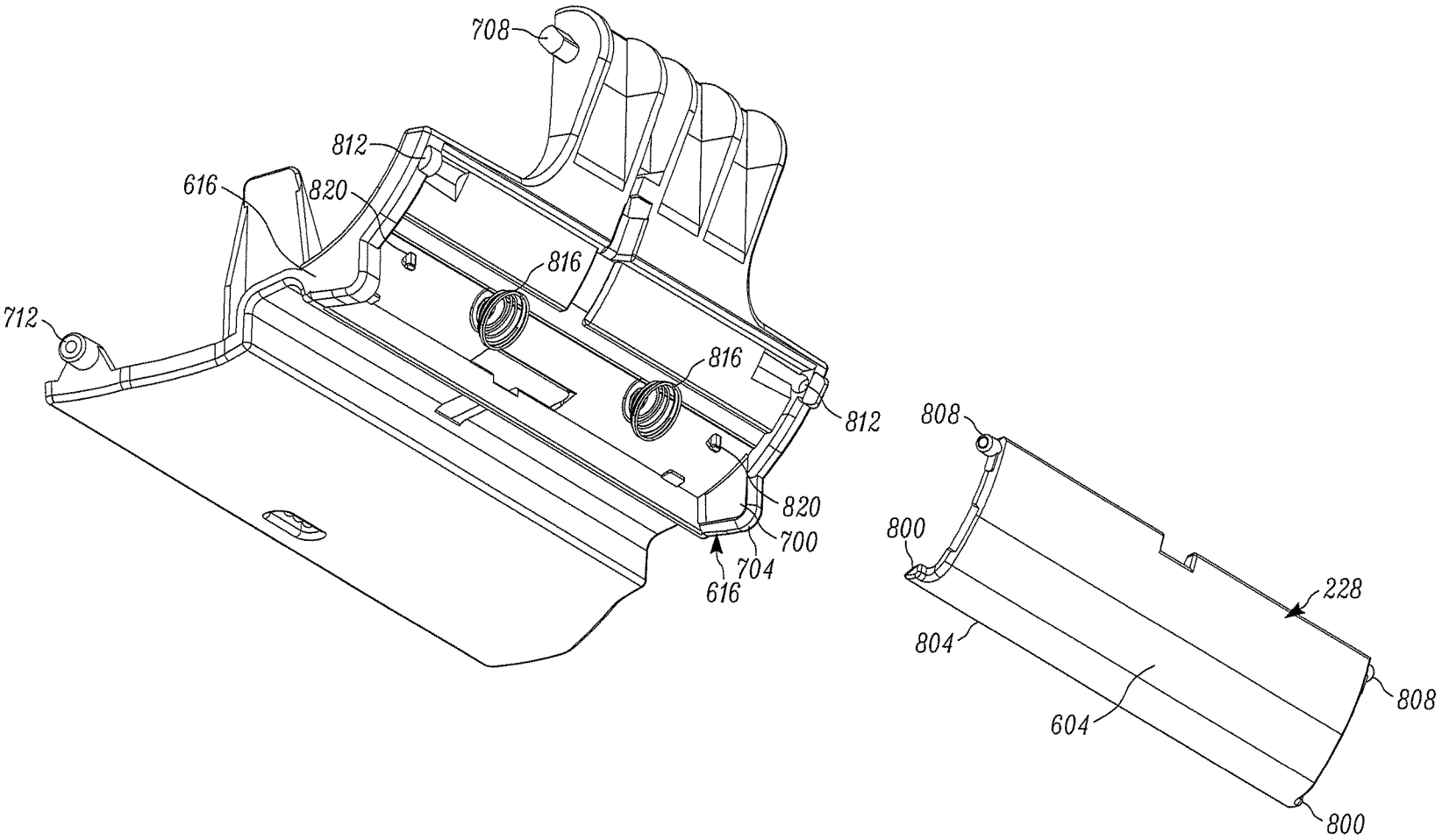
FIG. 8 depicts an exploded view of the arm and the movable media guide of FIGS. 6 and 7.

Referring to FIG. 8, in the example media processing device 100, the movable media guide 228 is configured to engage the walls 704 by way of a pair of stops 800 extending laterally from opposing sides of the surface 604. More specifically, the stops 800 extend from the sides of the surface 604 at or adjacent to a downstream edge 804 of the movable media guide 228. The term "downstream" as used herein refers to the direction toward the media exit 112 along the media feed path 304. That is, a first element downstream of a second element is closer to the media exit 112 than the second element. Each stop 800 is configured to extend into a corresponding one of the cavities 700 of the shoulders 616, and to engage with the corresponding wall 704 when the movable media guide 228 is in the extended position.

As illustrated in FIG. 8, the movable media guide 228 includes a pair of pins 808 extending laterally from the above-mentioned opposing sides of the movable media guide 228. The pins 808 extend from the sides of the movable media guide 228 at or adjacent to an upstream edge of the movable media guide 228. The term "upstream" as used herein refers to the direction toward the cavity 200 (and therefore the spool 300, when the spool 300 is present) along the media feed path 304. That is, a first element upstream of a second element is closer to the cavity 200 than the second element. The pins 808 engage corresponding recesses 812 of the arm 224 and are configured to rotate within the recesses 812, thus enabling the above-mentioned movement (e.g., rotation) of the movable media guide 228 about the axis 612.

Figure 9:
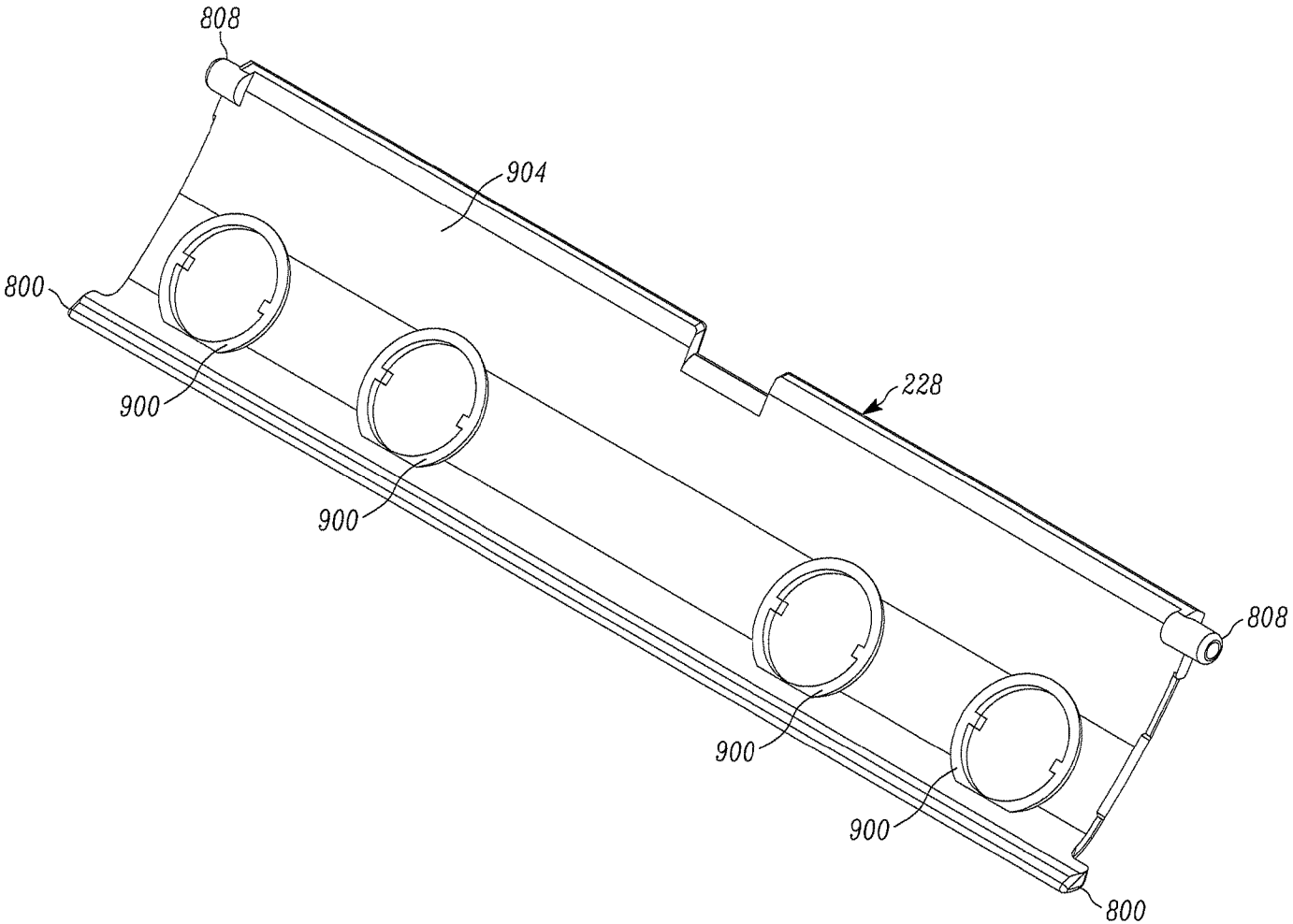
FIG. 9 depicts the movable media guide of FIGS. 6-8.

As noted earlier, the movable media guide 228 is biased toward the media feed path 304. The example media processing device 100 includes at least one biasing device to bias the movable media guide 228. In particular, as seen in FIG. 8, the media processing device 100 includes first and second biasing devices 816, in the form of tapered coil springs. In this example, the biasing devices 816 are connected to the arm 224 via engagement between the tapered end of the springs and protrusions 820 extending from the arm 224. The biasing devices 816 are also connected to the movable media guide 228, as seen in FIG. 9, by depressions 900 in a surface 904 opposite the convexly curved surface 604. Depressions 900 are configured to receive and secure the bases of the coiled springs shown in FIG. 8.

In some examples, the biasing devices 816 are connected to only one of the arm 224 and the movable media guide 228, and thus either the depressions 900 or the protrusions 820 can be omitted. Various other biasing devices are also contemplated. For example, in other implementations the coiled springs shown in FIGS. 8 and 9 are substituted with springs mounted about the pins 808, with arms extending therefrom to engage the arm 224 and the movable media guide 228. In some implementations, other biasing devices, such as leaf springs, are employed to bias the movable media guide 228 toward the media feed path 304. In some example implementations, combinations of any of the above-mentioned biasing devices, or of any other suitable biasing devices, are employed to bias the movable media guide 228.

Figure 10:
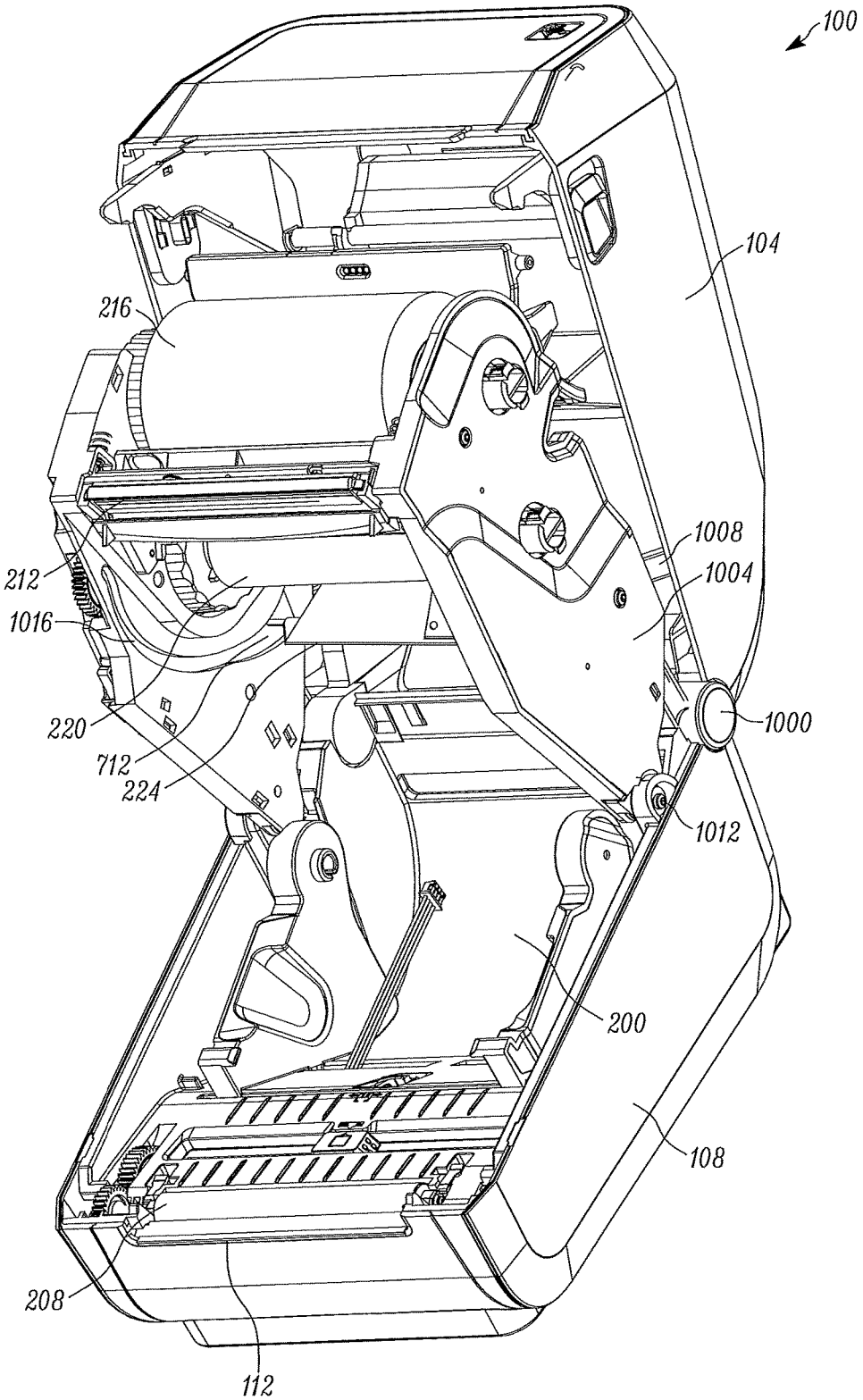
FIG. 10 depicts the media processing device of FIG. 1 in an open position.

As noted earlier, the fixed media guide is referred to as "fixed" because it is immobile relative to the cover 104 at least during operation of the media processing device 100. In the example media processing device 100, certain components of the fixed media guide, such as the arm 224, need not be fixed under all conditions. Referring to FIG. 10, the cover 104 is seen in an open position, in contrast to the closed position illustrated in FIGS. 1-4. The cover 104 is movable about a joint 1000 between the closed and open positions.

The media processing device 100 also includes a carriage 1004 configured to support the roller cartridge containing the rollers 216 and 220, as well as the printhead 212. The carriage 1004 is movably coupled to the cover 104 by a pair of opposing linkages 1008, and is also rotatably coupled to the base 108 at a joint 1012. The carriage 1004 is therefore opened when the cover 104 is opened, but the carriage 1004 rotates relative to the base 108 about a different axis than does the cover 104. As a result, the cover 104 and the carriage 1004 move relative to each other during their transition to the open position shown in FIG. 10. The arm 224, as noted earlier, is connected to the cover 104 by the axle pins 708. The arm 224 is also connected to the carriage 1004, however, by engagement between the guide pins 712 and a track 1016 in the carriage 1004.

The arm 224 is therefore configured to move from an operational position (shown in FIGS. 1-4) to a maintenance position shown in FIG. 10 when the cover 104 is opened. More specifically, the arm 224 rotates relative to the cover 104 about the axle pins 708, and translates relative to the carriage 1004 as the guide pins 712 slide in the corresponding tracks 1016. The arm 224 is nevertheless referred to herein as a component of the fixed media guide because, when the cover 104 is closed, the arm 224 is fixed in the operational position, and is substantially immobilized relative to both the cover 104 and the carriage 1004. In the operational position, the arm 224 is configured to locate the movable media guide 228 in the position between the cavity 200 and the platen roller 208, as illustrated in FIGS. 1-4.

In other implementations, the arm 224 can be fixed relative to the cover 104 and the carriage 1004 under all conditions. In further examples, the arm 224 is omitted from the media processing device 100, and the movable media guide 228 is movably coupled directly to the cover 104 or to the carriage 1004. For example, the pins 808 can extend into recesses on inner walls of the carriage 1004.

Figure 11:
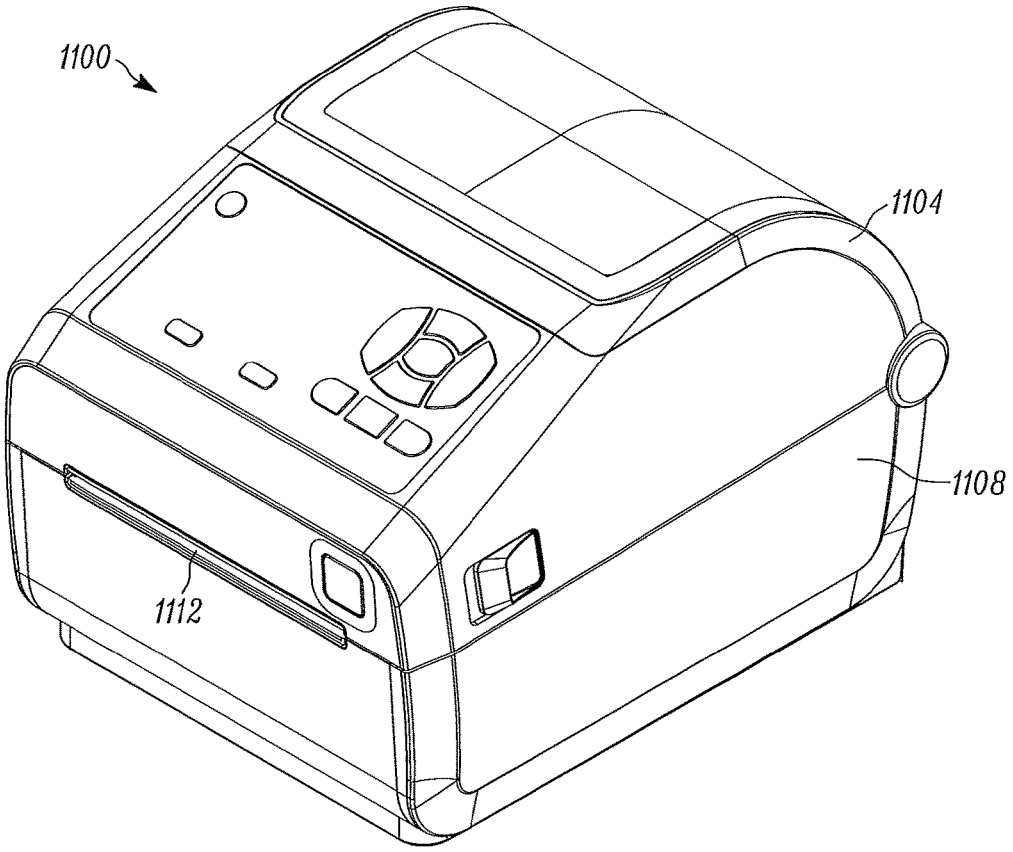
FIG. 11 depicts a further example media processing device.

FIG. 11 depicts a further example media processing device 1100 constructed in accordance with teachings of this disclosure. The media processing device 1100 includes a housing defined by a cover 1104 and a base 1108. As will be described herein, the media processing device 1100 stores a supply of print media and generates indicia on the print media before dispensing the print media from a media exit 1112 in the housing. In the illustrated example, the media processing device 1100 employs direct thermal printing technology, rather than thermal transfer printing, to alter the color of the thermal print media.

Figure 12:
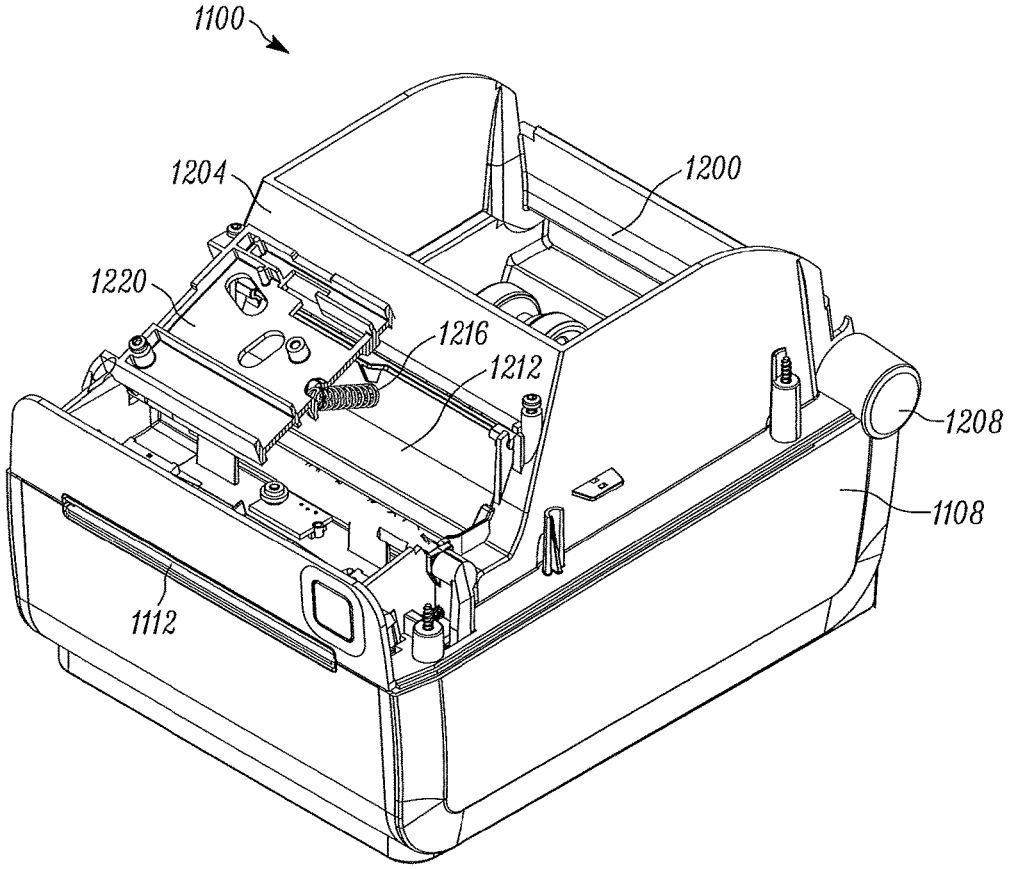
FIG. 12 depicts a partial section view of the media processing device of FIG. 11.

Turning to FIG. 12, a partial cutaway view of the example media processing device 1100 of FIG. 1 is depicted, in which the cover 1104 is omitted. As seen in FIG. 12, the media processing device 1100 includes a cavity 1200 configured to receive a supply of print media. The supply of print media, in the example media processing device 1100, is a spool (omitted in FIG. 12) configured to be received within the cavity 1200. The print media is a web of paper, labels or the like rolled around the spool in a stored state, and the spool is rotatable within the cavity 1200 to dispense (i.e. unroll) the print media.

The example media processing device 1100 also includes a fixed media guide configured to guide the web dispensed from the spool along a media feed path, to be described below in greater detail, from the cavity 1200 toward the media exit 1112. The fixed media guide includes a frame 1204 that is coupled to the base 1108. The frame 1204 is fixed relative to the cover 1104, although the frame 1204 and the cover 1104 are movable together relative to the base 1108, permitting the media processing device 1100 to be opened for maintenance. For example, in the media processing device 1100 the cover 1104 is fixed to the frame 1204, which is in turn movably coupled to the base 1108 at a joint 1208.

The example media processing device 1100 also includes a movable media guide 1212 at a position along the media feed path between the cavity 1200 and the media exit 1112. The movable media guide 1212 extends laterally across the media feed path. In other words, as discussed above in connection with the movable media guide 228, the longest dimension of the movable media guide 1212 lies perpendicular to the direction of travel of the web (from the cavity 1200 toward the media exit 1112). As will be discussed in greater detail below, the movable media guide 1212 is biased toward the media feed path by a biasing device 1216, and is configured to apply a dampening force to the web as the web travels along the media feed path.

In the illustrated example, the biasing device 1216 is a helical spring connected to the movable media guide 1212 and to a control panel support 1220 configured to be fixed to the cover 1104. In other examples, the biasing device 1216 is connected directly to the cover 1104 rather than to the control panel support 1220. More generally, the biasing device 1216 is connected at opposing ends to the movable media guide 1212 and any suitable fixed surface of the media processing device 1100.

Figure 13:
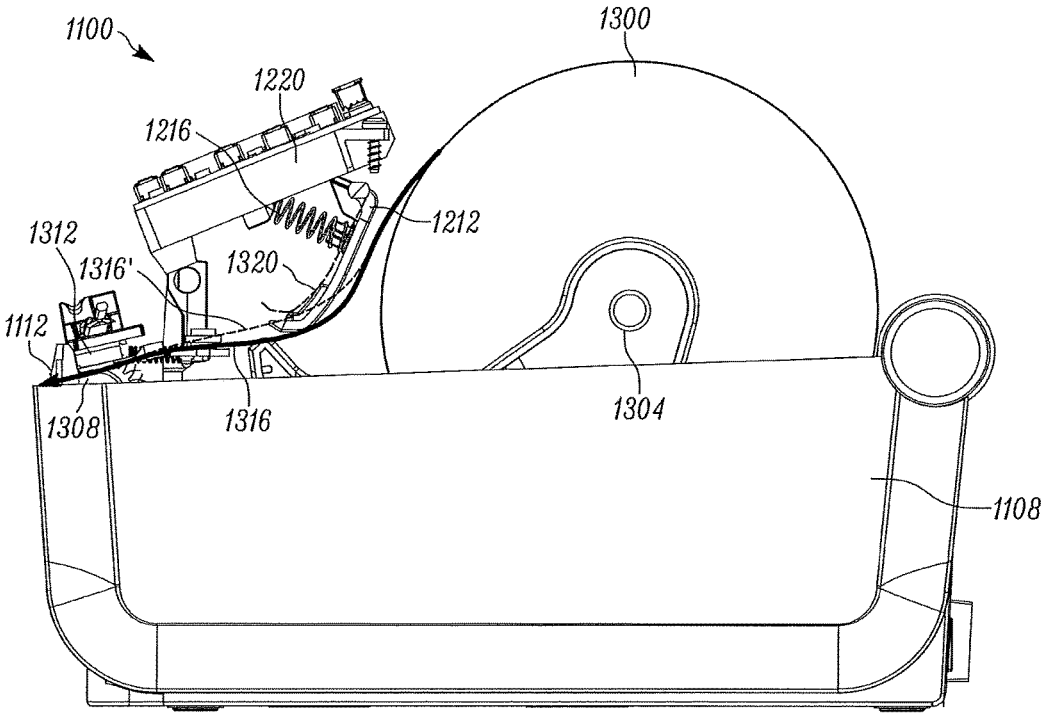
FIG. 13 depicts a partial side view of the media processing device of FIG. 11.

Turning to FIG. 13, a side view of the example media processing device 1100 is illustrated, with the cover 1104 and the frame 1204 omitted. FIG. 13 illustrates a spool 1300 storing a rolled media web in the cavity 1200. The spool is rotatable (e.g. about a spindle 1304) within the cavity 1200 to dispense (i.e. unroll) the print media, under the action of a platen roller 1308. The platen roller 1308, in conjunction with a printhead 1312, forms a nip through which the print media passes toward the media exit 1112. The platen roller 1308 pulls the web from the spool 1300 through the nip and toward the media exit 1112. In this example, as noted earlier, the media processing device 1100 is a direct thermal printer, and therefore during printing operations, direct thermal media (but not an ink ribbon) is fed across the printhead 1312 and certain elements (e.g., printhead dots) of the printhead 1312 are selectively energized (e.g., heated) according to machine-readable instructions (e.g., print line data or a bitmap). When energized, the elements of the printhead 1312 apply energy (e.g., heat) directly to the print media, which changes color (e.g., from white to black or color) in response to the energy.

Also shown in FIG. 13 is a media feed path 1316. The media feed path 1316 begins at the spool 1300, and travels along the movable media guide 1212 (which is convexly curved toward the media feed path 1316) and the fixed media guide before reaching the above-mentioned nip and finally the media exit 1112. The platen roller 1308 is configured to move the web along the media feed path 1316 from the cavity 1200 toward the media exit 1112.

The media feed path 1316 illustrated in FIG. 13 is the path along which the web from the spool 1300 lies when the media processing device 1100 is at rest (that is, when the platen roller 1308 is not pulling the web toward the nip). In particular, the media feed path 1304 shown in FIG. 13 indicates a degree of slack adjacent to the movable media guide 1212. As discussed earlier in connection with the media processing device 100, the slack arises, for example, due to residual motion of the spool 1300 when the platen roller 1308 ceases rotating.

As the movable media guide 1212 is biased toward the media feed path 1316, the movable media guide 1212 is shown in FIG. 13 in an extended position, in which the movable media guide 1212 contacts the web lying along the media feed path 1316. In some examples, the movable media guide 1212 exerts a force on the web sufficient to straighten the web downstream (i.e. toward the platen roller 1308) of the movable media guide 1212. In other examples, however, the movable media guide 1212 does not exert such a force on the web when the web is at rest and lying along the media feed path 1316.

When the platen roller 1308 begins to rotate, the platen roller 1308 is configured both to take up the above-mentioned slack, and to accelerate the spool 1300 from rest to dispense additional print media. In taking up any slack in the web and in accelerating the spool 1300 to an operating speed, the platen roller 1308 rapidly increases the tension on the web. The rapid increase in tension causes the web to deviate from the media feed path 1316 to a modified media feed path 1316', shown in FIG. 13 as a dashed line.

The movable media guide 1212 is configured, as a result of its bias toward the media feed path 1316 (i.e. the resting media feed path), to apply a force to the web to dampen the movement of the web from the media feed path 1316 to the modified media feed path 1316'. In dampening the movement of the web away from the media feed path 1316 and toward the modified media feed path 1316', the movable media guide 1212 is configured to move from the extended position shown in solid lines in FIG. 13 to a compressed position 1320 shown as a dashed lines.

When the platen roller 1308 ceases rotating, the web also ceases travelling through the nip. The spool 1300 decelerates and comes to a stop. However, during the deceleration of the spool 1300, additional print media is dispensed from the spool 1300 that is not drawn along the media feed path 1316' (as the platen roller 1308 is no longer in motion). Therefore, the media web incurs some slack and returns to lie at rest along the media feed path 1316. The letting out of slack in the media web, along with the bias of the movable media guide 1212, causes the movable media guide 1212 to return to the extended position, in preparation to dampen a subsequent movement of the web toward the modified media path 1316' when operation of the media processing device 1100 resumes.

Figure 14:
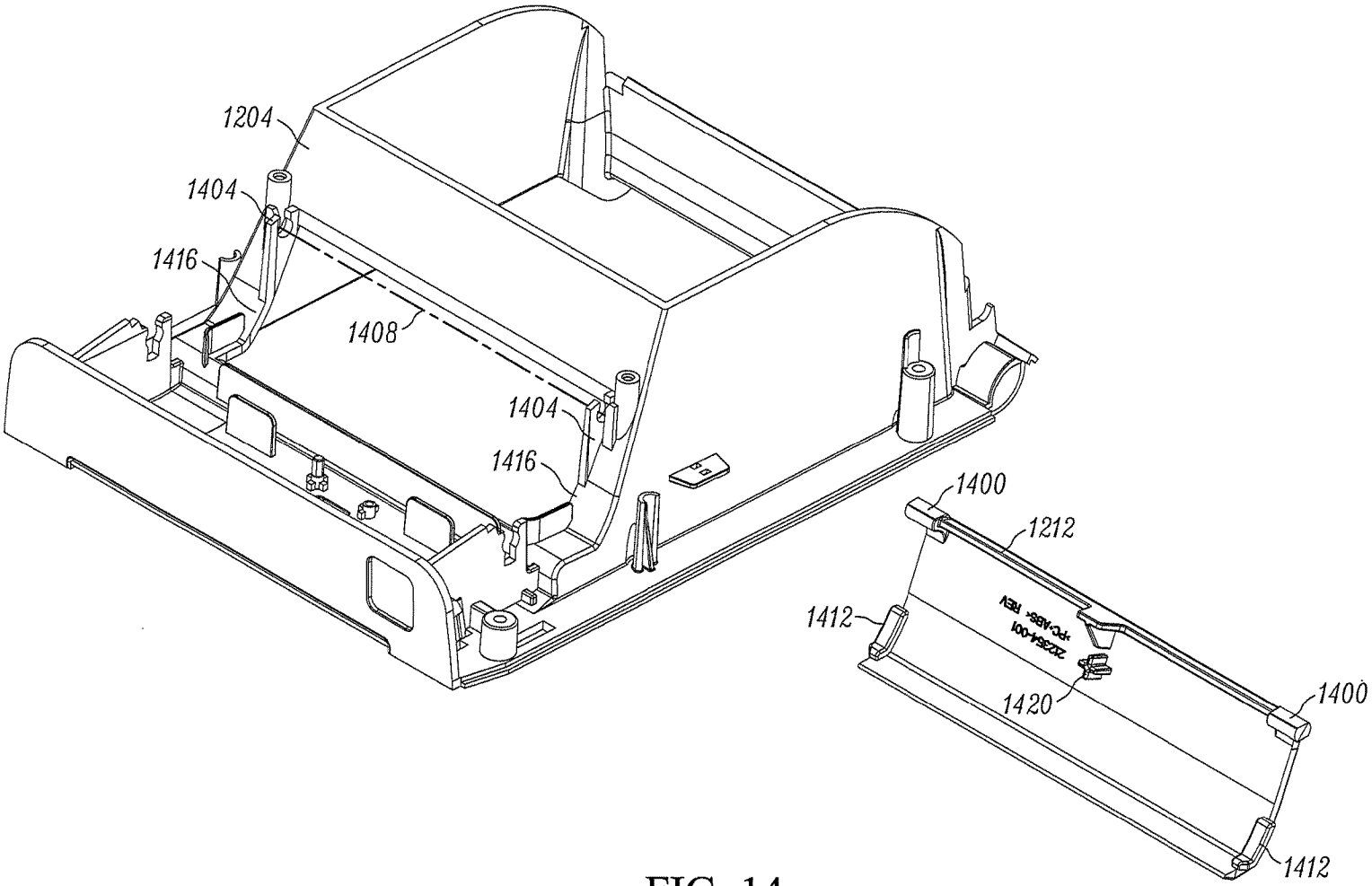
FIG. 14 depicts an exploded view of a frame and a movable media guide of the media processing device of FIG. 11.

Referring now to FIG. 14, an example structural arrangement is illustrated for movably coupling the movable media guide 1212 to the frame 1204. FIG. 14 illustrates the frame 1204 and the movable media guide 1212 in a disassembled state, isolated from the remainder of the media processing device 1100. The movable media guide 1212 includes a pair of pins 1400 extending laterally from opposing sides of the movable media guide 1212. The pins 1400 extend from the sides of the movable media guide 1212 at or adjacent to an upstream edge of the movable media guide 1212, and are configured to engage corresponding recesses, provided in the illustrated example as cradles 1404 on the frame 1204. The pins 1400 are configured to rotate within the cradles 1404, thus enabling movement (e.g., rotation) of the movable media guide 1212 about an axis 1408 defined between the two points of contact between the frame 1204 and the movable media guide 1212.

The movable media guide 1212 further includes a pair of stops 1412 extending laterally from opposing sides of the movable media guide 1212. In the illustrated example, the stops 1412 extend from the sides of the movable media guide 1212 at or adjacent to a downstream edge of the movable media guide 1212. The stops 1412 are configured to engage respective contact portions 1416 of the frame 1204 when the movable media guide 1212 is in the extended position (as seen, for example, in FIG. 12). In other words, the stops 1412 are configured to limit the extension of the movable media guide 1212 toward the media feed path 1316 under the biasing action of the biasing device 1216.

The movable media guide 1212 also includes a protrusion 1420 extending from a surface thereof (specifically, the surface facing away from the media feed path 1316 in the illustrated example). The protrusion 1420 is configured to couple one end of the biasing device 1216 to the movable media guide. In other examples, additional protrusions are provided on the movable media guide 1212 to couple additional biasing devices thereto. In further examples, the protrusion 1420 is replaced with a depression such as that shown in FIG. 9 and discussed in connection with the example media processing device 100. In still further examples, the protrusion 1420 is omitted; for example, the biasing device 1216 as shown in FIG. 12 is replaced with a coiled spring at one or both of the pins 1400. Each such spring includes a pair of arms contacting, respectively, the movable media guide 1212 and the frame 1204.

In further example media processing devices, combinations of the structural features of the example media processing devices 100 and 1100 are implemented. For example, a further media processing device includes a frame similar to the frame 1204 as shown in FIG. 14, with shoulders such as those shown in FIG. 7. The movable media guide in such an example media processing device includes stops such as stops 800 shown in FIG. 8 for engaging the shoulders, rather than the stops 1412 shown in FIG. 14.

In the foregoing specification, specific implementations have been described. However, one of ordinary skill in the art appreciates that various modifications and changes can be made without departing from the scope of the specification as set forth in the claims below. Accordingly, the specification and figures are to be regarded in an illustrative rather than a restrictive sense, and all such modifications are intended to be included within the scope of present teachings.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting implementation the term is defined to be within 10%, in another implementation within 5%, in another implementation within 1% and in another implementation within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some implementations may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an implementation can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The invention claimed is:

1. A media processing device comprising:

a cavity configured to receive a supply of media;

a media exit;

a fixed media guide configured to guide the media along a media feed path from the cavity to the media exit;

a platen roller configured to move the media along the media feed path from the supply toward the media exit;

a movable media guide extending laterally across the media feed path at a position between the platen roller and the cavity, the movable media guide biased toward the media feed path and configured to apply a force to the media, wherein the movable media guide is convexly curved toward the media feed path; and a cover configured to move between an open position and a closed position, wherein the movable media guide is movably coupled to the cover.

2. The media processing device of claim 1, wherein the supply comprises a spool, the media being in a stored state on the spool, and wherein the movable media guide is configured to straighten the media as the media moves from the spool to the media exit.

3. The media processing device of claim 1, wherein the movable media guide is configured to dampen movement of the media away from the media feed path when the platen roller begins to move the media.

4. The media processing device of claim 1, wherein the movable media guide comprises:

a surface extending laterally across the media feed path; and a biasing device configured to bias the movable media guide toward the media feed path.

5. The media processing device of claim 1, further comprising a printhead, wherein the platen roller and the printhead form a nip.

6. The media processing device of claim 1, the fixed media guide comprising an arm coupled to the cover, the movable media guide being movably coupled to the arm.

7. The media processing device of claim 6, the arm being movably coupled to the cover and configured to move between a maintenance position when the cover is in the open position, and an operational position when the cover is in the closed position;

wherein the arm is fixed in the operational position when the cover is in the closed position.

8. The media processing device of claim 6, the movable media guide comprising a pair of pins extending laterally from opposing sides of the movable media guide and configured to engage corresponding recesses in the arm to rotatably couple the movable media guide to the arm.

9. The media processing device of claim 8, the pair of pins extending laterally from the opposing sides adjacent to an upstream edge of the movable media guide.

10. The media processing device of claim 8, the arm comprising a shoulder extending from a side of the arm adjacent to the media feed path;

the shoulder defining a cavity therein;

the movable media guide comprising a stop extending laterally from a side of the movable media guide and configured to engage a wall of the cavity when the movable media guide is in an extended position.

11. The media processing device of claim 10, the stop extending laterally from the side adjacent to a downstream edge of the movable media guide.

12. The media processing device of claim 6, further comprising a biasing device coupled between the arm and the movable media guide.

13. The media processing device of claim 12, the biasing device comprising a spring coupled between the arm and the movable media guide.

14. The media processing device of claim 1, the fixed media guide comprising a frame fixed to the cover;

the movable media guide being movably coupled to the frame.

15. The media processing device of claim 14, the movable media guide comprising a pair of pins extending laterally from opposing sides of the movable media guide and configured to engage corresponding recesses of the frame to rotatably couple the movable media guide to the frame.

16. The media processing device of claim 14, the movable media guide comprising a stop extending laterally from a side of the movable media guide and configured to engage a wall of the frame when the movable media guide is in an extended position.

* * * * *